United States Patent [19]

Nomura

[11] 4,090,350

[45] May 23, 1978

[54] ELECTRONIC TIMEPIECE

[75] Inventor: Yasushi Nomura, Tokorozawa, Japan

[73] Assignee: Citizen Watch Co., Limited, Tokyo, Japan

[21] Appl. No.: 682,667

[22] Filed: May 3, 1976

[30] Foreign Application Priority Data

May 6, 1975 Japan ..... 50/53999
Feb. 16, 1976 Japan ..... 51/16977

[51] Int. Cl.[2] ..... G04B 27/08; G04C 3/00
[52] U.S. Cl. ..... 58/23 R; 58/50 R; 58/58; 58/85.5
[58] Field of Search ..... 58/4 A, 23 R, 50 R, 58/58, 85.5

[56] References Cited

U.S. PATENT DOCUMENTS

| | | | |
|---|---|---|---|
| 3,760,582 | 9/1973 | Thiess et al. | 58/50 R |
| 3,810,356 | 5/1974 | Fujita | 58/23 R |
| 3,913,312 | 10/1975 | Numabe | 58/50 R |
| 3,998,044 | 12/1976 | Yamauchi et al. | 58/23 R |
| 4,004,407 | 1/1977 | Fujita | 58/23 R |

*Primary Examiner*—Stanley J. Witkowski
*Attorney, Agent, or Firm*—Holman & Stern

[57] ABSTRACT

A switch mechanism for an electronic timepiece comprises a minimum number of control switches and an electric circuit means associated therewith. The electric circuit means is arranged such that when the control switches are actuated independently of each other the control switches provide respective switching functions whereas when selected ones of the control switches are concurrently actuated respective switching functions of the control switches are inhibited and, instead thereof, another switching function is provided.

17 Claims, 7 Drawing Figures

DISPLAY DEVICE
DISPLAY DRIVER
DATE COUNTER
HOURS COUNTER
MINUTES COUNTER
SECONDS COUNTER
FREQUENCY CONVERTER
FREQUENCY STANDARD

12:30
28

ELECTRONIC TIMEPIECE

BACKGROUND OF THE INVENTION

This invention relates in general to electronic timepieces and, more particularly, to an improvement over such electronic timepieces having a plurality of control switches to perform various functions.

In general, modern electronic timepieces include integrated circuits and photoelectric display elements such as light-emitting diode, electrochromism and liquid crystal etc. These electronic timepieces usually provide various functions such as time setting and seconds zeroing in addition to basic timekeeping function. In electronic timepieces of the time-dial type, it has also been proposed to provide multi-functions in addition to their basic timekeeping function.

A problem is encountered in the prior art electronic timepieces of the type mentioned above in that a large number of control switches are necessarily incorporated in the watch cases resulting in an increased size of the timepieces. To solve this problem, various attempts have heretofore been made to provide control switches which can perform the desired functions. Typical one of these control switches is a crown which is adapted to be axially movable in stepwise fashion and also rotatable in either direction to provide a multi-switching function.

Another expedient is to utilize the number of times of manual operation of the control switch or the time interval in which the control switch is manually operated to provide a plurality of switching functions. A problem is also encountered with these prior art expedients in that not only a manual operation of the control switches will be difficult to achieve but also the electronic timepieces will be complicated in circuit arrangement.

SUMMARY OF THE INVENTION

It is, therefore, an object of the present invention to provide an improved electronic timepiece having a simple switching arrangement to provide ease of manual operation to achieve various functions.

It is another object of the present invention to provide an improved electronic timepiece having a minimum number of control switches adapted to provide a multi-switching function.

It is still another object of the present invention to provide a switch mechanism specifically suited for use in an electronic timepiece adapted to provide a multi-function in addition to its basic timekeeping function.

It is a further object of the present invention to provide a switch mechanism for an electronic timepiece adapted to provide a multi-function in addition to its basic timekeeping function, which switch mechanism is simple in construction, easy to manipulate and highly reliable in operation.

In order to achieve these objects, the present invention features the provision of a plurality of control switches adapted to provide respective switching functions when they are actuated independently of each other. The switch mechanism is arranged such that when selected ones of the control switches are concurrently actuated respective switching functions of the control switches are inhibited and, instead thereof, another switching function is provided.

BRIEF DESCRIPTION OF THE DRAWINGS

These and other objects, features and advantages of the present invention will become more apparent from the following description when taken in conjunction with the accompanying drawings, in which.

DETAILED DESCRIPTON OF A PREFERRED EMBODIMENT

Figures 1, 2:
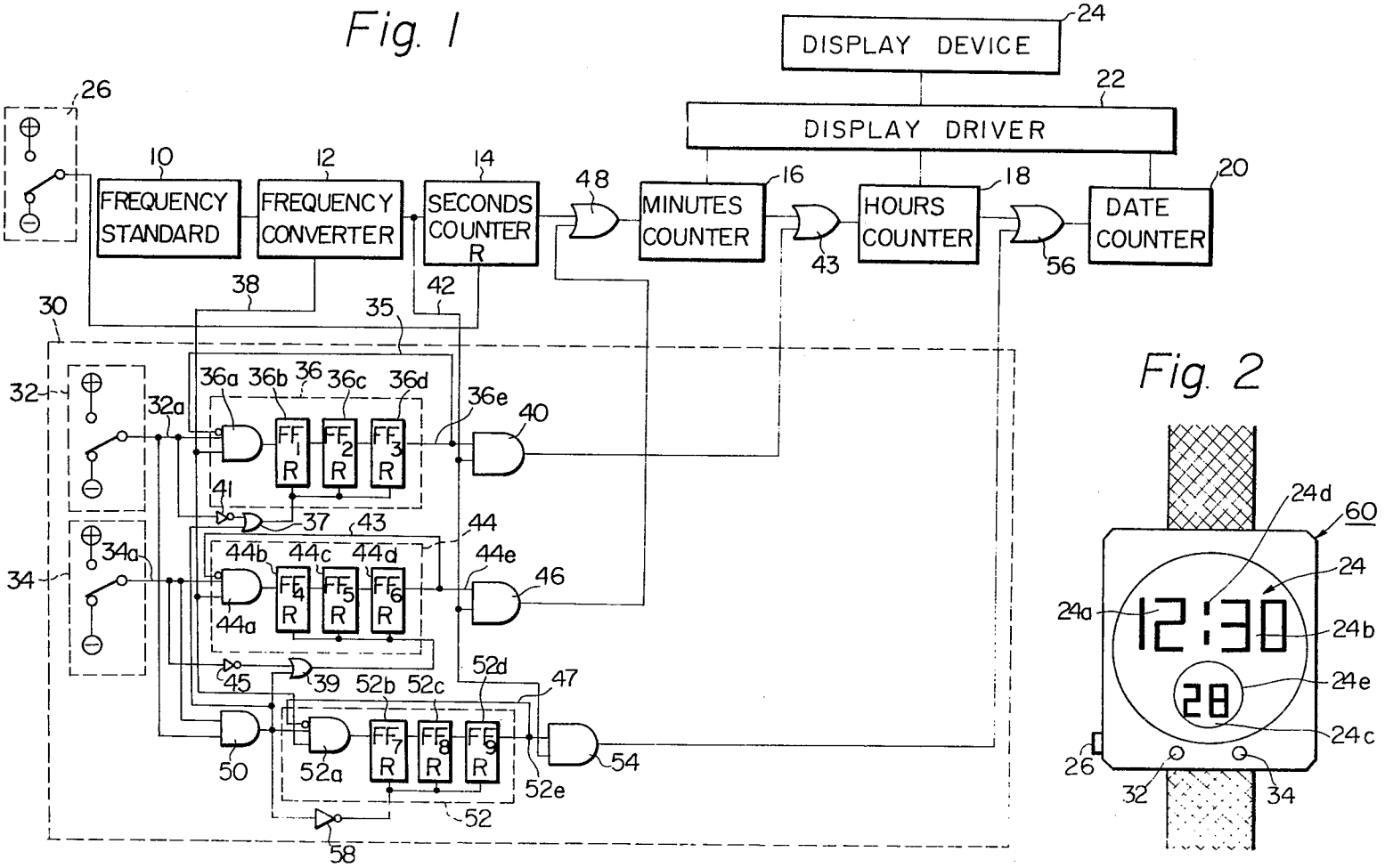
FIG. 1 is a schematic view of an electronic timepiece incorporating a switch mechanism according to the present invention.
FIG. 2 is a schematic view illustrating the face of an electronic wristwatch incorporating the switch mechanism shown in FIG. 1.

Referring now to FIG. 1, there is schematically shown a detail electric circuitry for an electronic timepiece incorporating a switch mechanism according to the present invention. As shown, the electronic timepiece generally comprises a frequency standard 10, a frequency converter 12, a seconds counter 14, a minutes counter 16, an hours counter 18, a date counter 20, a display driver 22 and a display device 24. The frequency standard 10 provides a high frequency time standard signal, which is applied to the frequency converter 12. The frequency converter 12 includes a plurality of binary counters (not shown), by which the high frequency signal is converted to a precise lower frequency signal. This signal is subsequently frequency-divided by a chain of counter circuits. Of these, the counter 14 divides a low frequency signal by sixty to give a seconds output. The counter 16 divides the seconds by sixty to give minutes output. The counter 18 divides the minutes by sixty to give an hours output. The counter 20 divides the hours by twelve to give a date output. The outputs from counter 16, 18 and 20 are supplied to the display driver 22, which drives the display devie 24. A second zeroing switch 26 is connected to a reset terminal of the seconds counter 14. This switch 26 is normally held in low level condition, and when the switch 26 is depressed the seconds counter 14 is reset to zero. The frequency standard 10, frequency converter 12, seconds counter 14, minutes counter 16, hours counter 18, date counter 20, display driver 22 and display device 24 are well known in the art and, therefore, a detail description of the same is herein omitted for the sake of simplicity of description.

The switch mechanism generally designated at 30 comprises first and second control switches 32 and 34, which are normally held in a low level condition and generate logically high level signals at their outputs **32*a* and 34*a* when depressed. The output 32*a* is connected to a timer 36. The timer 36 comprises an AND gate 36*a*, and a plurality of flip-flops 36*b*, 36*c* and 36*d* (FF1, FF2 and FF3, respectively) connected to the output of the AND gate 36*a*. The AND gate 36*a* has its inputs connected to the output 32*a* of the first control switch 32 and an intermediate stage of the frequency converter 12** through a lead 38 to receive a clock pulse therefrom. The AND gate 36a also has an inverted input coupled through a lead 35 to an output 36e of the timer 36. The flip-flops 36b, 36c and 36d are connected in series. When a high level signal appears on output 32a, the AND gate 36a is enabled to pass the clock pulse from the frequency converter 12 and the flip-fop 36d assumes "1" state on its output 36e after a predetermined time interval, i.e., 0.5 seconds. The output 36e is coupled to one input of an AND gate 40, the other input of which is coupled through a lead 42 to the output of the frequency counter 12 to receive an output pulse therefrom. When the output on lead 36e is at high level, the AND gate 40 generates an hours correction pulse which is applied through an OR gate 43 to the hours counter 18, thereby correcting hours.

Similarly, the output 34a is coupled to one input of an AND gate 44a of a timer 44, the other input of which is coupled to the lead 38 to receive the clock pulse from the frequency converter 12. The timer 44 comprises an AND gate 44a, and flip-flops 44b, 44c and 44d (FF4, FF5 and FF6, respectively which are connected in series to provide an output on lead 44e after a predetermined time interval of, for example, 0.5 seconds. The AND gate 44a has its inputs connected to the output 34a of the second control switch 34 and the frequency converter 12 through the lead 38 to receive a clock pulse therefrom. The AND gate 44a also has an inverted input coupled through a lead 43 to an output 44e of the timer 44. The output 44e is applied to one input of an AND gate 46 having its other input connected to the lead 42 coupled to the output of the frequency coverter 12 to receive the output pulse therefrom. When the output on lead 44e is at high level, the AND gate 46 generates a minutes correction pulse. The minutes correction pulse is applied through an OR gate 48 to the minutes counter 16, thereby correcting minutes.

The outputs 32a and 34a of the first and second control switches 32 and 34 are also coupled to an AND gate 50 whose output is coupled through OR gates 37 and 39 to reset terminals R of the flip-flops 36b, 36c and 36d of the timer 36 and reset terminals R of the flip-flops 44b, 44c and 44d of the timer 44, respectively, for thereby resetting these flip-flops when the output of the AND gate 50 becomes a high level. The OR gates 37 and 39 are also coupled at their inputs to the outputs 32a and 34a through inverters 41 and 45, respectively. The output of the AND gate 50 is also connected to one input of an AND gate 52a of a timer 52, the other input of which is coupled to the lead 38 to receive the clock pulse from the frequency converter 12. The AND gate 52a also has an inverted input coupled through a lead 47 to an output 52e of the timer 52. The timer 52 comprises a plurality of flip-flops 52b, 52c and 52d (FF7, FF8 and FF9, respectively) which are connected in series to provide an output on lead 52e after a predetermined time interval of, for example, 0.5 seconds. This output is connected to one input of an AND gate 54 whose other input is connected to the lead 42 to receive the output pulse from the frequency converter 12. When the output on lead 52e is at high level, the AND gate 54 generates a date correction signal. This date correction signal is applied through an OR gate 56 to the date counter 20, whereby the date is corrected. As shown, the output of the AND gate 50 is also coupled through an inverter 58 to reset terminals R of the flip-flops 52b, 52c and 52d of the timer 52 and, accordingly, these flip-flops are reset when the output of the AND gate 50 becomes low level.

With the arrangement mentioned above, if only the first control switch 32 is depressed, the output 32a becomes high, thereby enabling the AND gate 36a to pass the clock pulse from the frequency converter 12 therethrough. Thus, the timer 36 comprised of flip-flops 36b, 36c and 36d is energized to produce an output 36e when a predetermined time interval has passed after depression of the control switch 32. This output is applied to the AND gate 40 which consequently generates an hours correction pulse in response to the output pulse fed through the lead 42. The hours correction pulse is applied through the OR gate 43 to the hours counter 18, thereby correcting hours. Since, in this instance, the output 36e of the timer 36 is coupled to the inverted input of the AND gate 36a, the AND gate 36a is inhibited and, therefore, the output 36e of the timer 36 is maintained at high level. When, however, the control switch 32 is released, the output 32a becomes low level and the flip-flops 36b, 36c and 36d are reset by the action of the inverter 41 coupled to the output 32a.

If, in contrast, only the second control switch 34 is depressed, the output 34a becomes high level, thereby energizing the timer 44 which provides an output on lead 44e when a predetermined time interval has passed after the depression of the second control switch 34. This output is applied to the AND gate 46, which consequently generates a minutes correction pulse. This minutes correction pulse is applied through the OR gate 48 to the minutes counter 16 so that the minutes are corrected. The flip-flops 44b, 44c and 44d are reset when the control switch 34 is released and the output 44e becomes low level.

When, further, the first and second control switches 32 and 34 are concurrently depressed, the AND gate 50 generates an output of high level thereby resetting the timers 36 and 44. If, in this instance, there exists a time difference less than the predetermined time interval of, for example, 0.5 seconds between the depressions of the first and second control switches 32 and 34, the timer 36 is reset by the output of the AND gate 50 and, therefore, the AND gate 40 coupled to the timer 36 is inhibited. This is the same for the timer 44. In any way, when the first and second switches 32 and 34 are depressed at a substantially same time, the AND gates 40 and 46 are inhibited whereas the timer 52 is energized to produce an output when a predetermined time interval has passed after the depressions of the first and second control switches 32 and 34. This output is applied to the AND gate 54, which consequently generates a date correction pulse which is applied through the OR gate 56 to the date counter 20 by which the date is corrected.

It will now be appreciated that the preferred embodiment showin in FIG. 1 makes it possible to perform various modes of time correction with the use of a minimum number of control switches in combination with timers. While, in the preferred embodiment of FIG. 1, only two control switches have been shown and described, it should be noted that more than two control switches may also be utilized to perform various functions. In addition, while the control switches have been shown and described as means for performing time corrections, it should be understood that these control switches may perform other various functions such as modulation of display mode, correction of other functions additionally provided in the electronic timepiece, time-setting etc. If desired, a flip-flop having its clock terminal connected to the lead 38 may be provided between the control switch and an output synchronizing with the clock pulse from the frequency converter 12. This output enables the flip-flops of the timer to produce an output at an accurately predetermined time instant after depression of the control switch.

One preferred example of a liquid crystal display type wristwatch is illustrated in FIG. 2, in which like or corresponding component parts are designated by the same reference numerals as those used in FIG. 1. In FIG. 2, the wristwatch 60 has a display device 24 comprising an hours display element 24*a*, an minute display element 24*b*, a date display element 24*c*, a seconds display colon 24*d*, and an identification mark 24*e* surrounding the calendar display element 24*c*. In addition, the wristwatch comprises a first and second control switches 32 and 34, and a seconds zeroing switch 26.

Figure 3:
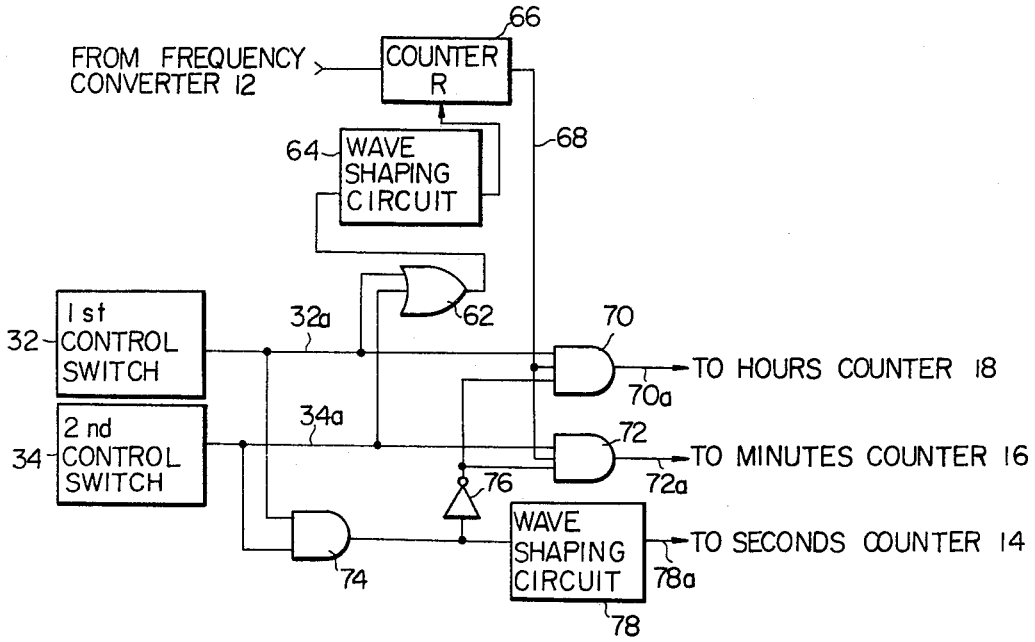
FIG. 3 is a circuit diagram of a second preferred embodiment of a switch mechanism according to the present invention.

FIG. 3 shows a second preferred embodiment of the switch mechanism according to the present invention. In FIG. 3, the first control switch 32 and the second control switch 34 are coupled through an OR gate 62 to a wave shaping circuit 64 which is arranged to provide an output pulse signal of narrow width during transitions between low and high levels of output 32*a* or 34*a*. The output pulse signal is applied to a reset terminal of a counter 66 having its set terminal coupled to the frequency converter 12 to receive a low frequency signal of, for example, 8 Hz. The counter 66 may be of any known type insofar as it functions to generate a time correction signal of 1 Hz on its output 68. The output of the counter 66 is coupled to AND gates 70 and 72, to which the outputs 32*a* and 34*a* are also connected respectively. The outputs 32*a* and 34*a* are also connected to inputs of an AND gate 74, whose output is coupled through an inverter 76 to the AND gate 70 and 72 and directly coupled to a wave shaping circuit 78 which is arranged to generate a seconds correction signal of narrow width during transitions between low and high levels of the output of the AND gate 74.

When, in operation, the first control switch 32 is depressed, the output 32*a* becomes high level. This output is applied through the OR gate 62 to the wave shaping circuit 64 which consequently generates an output pulse signal of narrow width during circuit state transitions. This output pulse signal is applied to the reset terminal of the counter 66, which is instantaneously reset for a predetermined time interval. After the predetermined time interval has passed, the counter 66 generates 1 Hz signal serving as a time correction signal, which is applied to the AND gate 70. At this instant, the AND gate 70 is enabled by the output 32*a* of the first control switch 32, generating an hours correction signal on its output 70*a* which is applied to the hours counter 18 for correcting the hours. Advancing of the hours is continued until the first control switch 32 is released.

When the second control switch 34 is depressed, the AND gate 72 is opened to pass the time correction signal as a minutes correction signal on output 72*a*. This minutes correction signal is applied to the minutes counter 16 which advances the minutes as previously mentioned.

When, further, the first and second control switches 32 and 34 are depressed at the same time, the output of the AND gate 74 becomes high so that the AND gates 70 and 72 are inhibited by the action of the inverter 76. In this case, even when there exists a time difference between the depressions of the first and second control switches 32 and 34, the AND gates 70 and 72 are inhibited before they receive time correction signal from the counter 66 and, therefore, no time correction is performed. However, the wave shaping circuit 78 generates a seconds correction signal of narrow width on output 78*a* during transitions between low and high levels of the output of the AND gate 74. The seconds correction signal is applied to the seconds counter 14, thereby permitting the correction of the seconds at the rate of 0.1 seconds.

In the embodiment of FIG. 3, the timers are replaced by a counter 66 whose output is coupled to the AND gates 70 and 72 in parallel and, therefore, a simple circuit arrangement can be obtained even when the number of control switches is increased. As already described with reference to the first preferred embodiment of the present invention, various combinations of logic level voltages applied by more than two control switches may be utilized to perform various functions other than time correction as exemplified by the following Table:

Table

| Operating modes of switches | | | |
|---|---|---|---|
| X | Y | Z | Functions to be performed |
| 0 | | | Flashing of a lamp |
| | 0 | | Saving electric power |
| | | 0 | Seconds zeroing |
| 0 | 0 | | Advancing hours |
| 0 | | 0 | Advancing minutes |
| | 0 | 0 | Advancing dates |
| 0 | 0 | 0 | Checking of battery life |

As shown in the above Table, various functions may be performed by various combinations of operating modes of a plurality of control switches. If the switch mechanism for the electronic timepiece incorporates three control switches X,Y and Z described above, the electric circuitry should be so arranged as to descriminate various operating modes of the control switches. This arrangement may be easily designed from the first and second embodiments mentioned hereinabove and, accordingly, a detailed description of the same as herein omitted.

Figure 4:
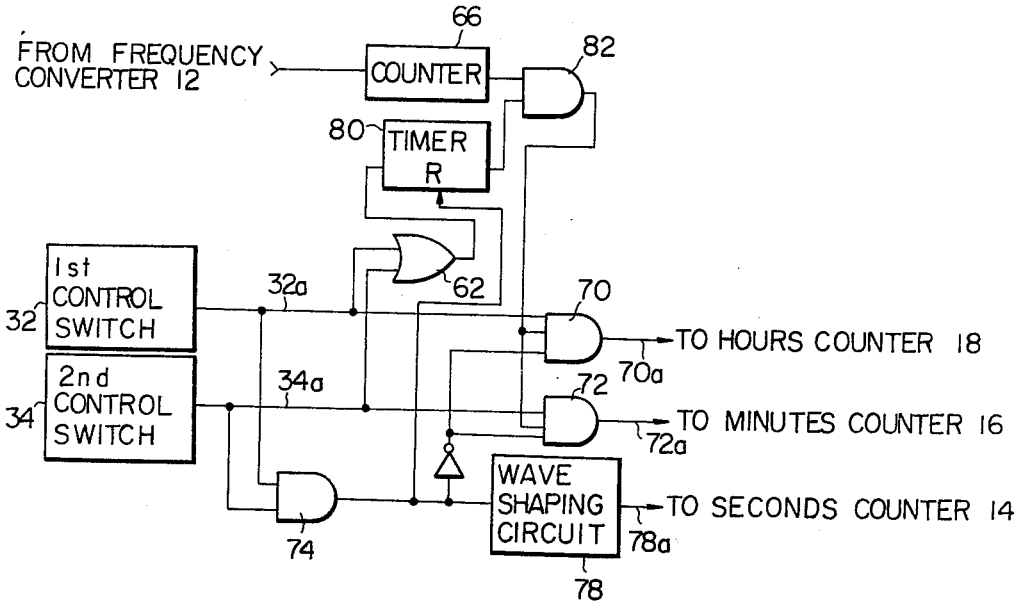
FIG. 4 is a modified form of the electric circuitry shown in FIG. 3.

A modified form of the switch mechanism is shown in FIG. 4 in which like or corresponding component parts are designated by the same reference numerals as those used in FIG. 3. This modification is similar in arrangement with the embodiment of FIG. 3 except that the wave shaping circuit 64 is replaced by a timer 80 and an AND gate 82. The timer 80 has its set terminal connected to the output of the OR gate 62 and its reset terminal connected to the output of the AND gate 74. The output of the timer 80 is coupled to one input of the AND gate 82 whose other input is connected to the output of the counter 66. The output of the AND gate 82 is coupled to the inputs of the AND gates 70 and 72. The switch mechanism thus arranged operates in a manner similar to the embodiment of FIG. 3 and, therefore, a detailed description of the same is omitted.

Figure 5:
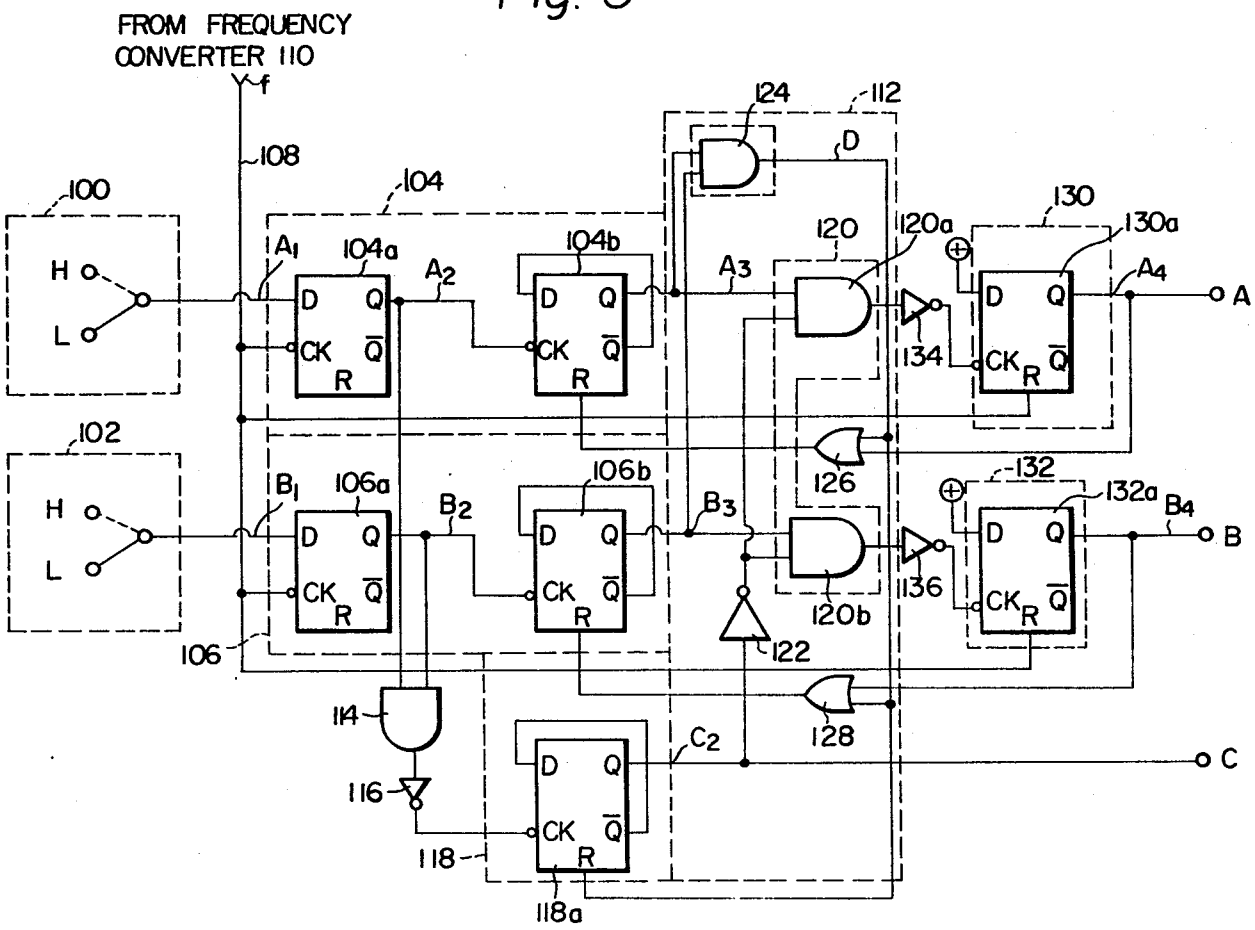
FIG. 5 is a circuit diagram showing a third preferred embodiment of a switch mechanism according to the present invention.
Figure 6:
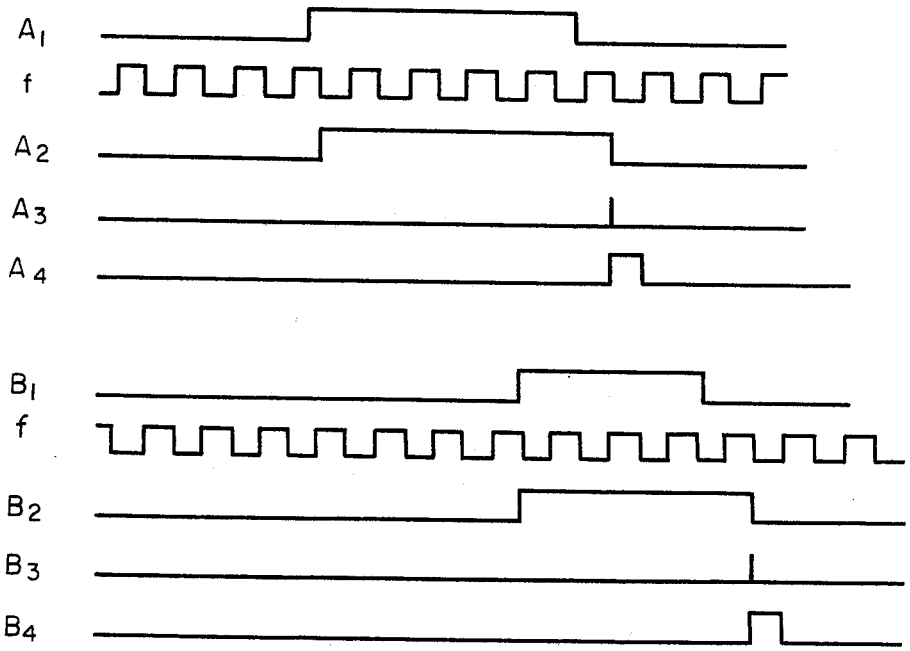
FIGS. 6 and 7 are waveform diagrams for the electric circuitry shown in FIG. 5.
Figure 7:
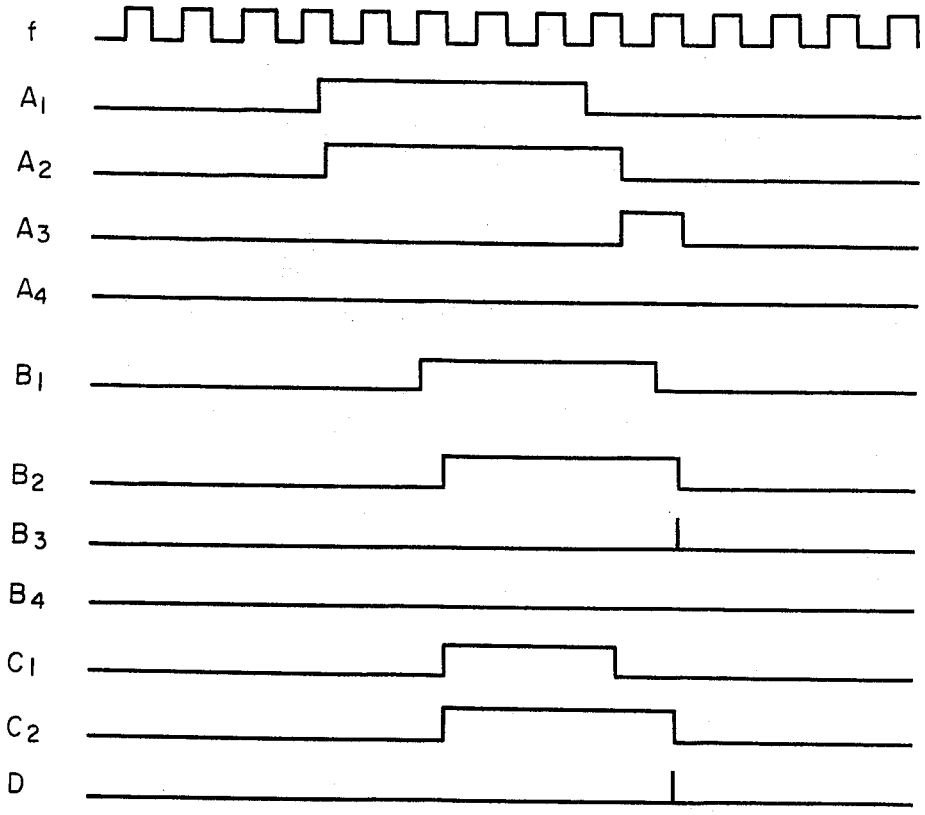

FIG. 5 shows a third preferred embodiment of the switch mechanism according to the present invention. In FIG. 5, the switch mechanism comprises first and second control switches 100 and 102, which are normally held in a low level condition and generate logically high level signals at their outputs A1 and B1 as shown in FIGS. 6 and 7 when depressed. The first and second control switches 100 and 102 are coupled to switching input circuits 104 and 106, respectively. The switching input circuit 104 is comprised of first and second trailing edge triggered data-type flip-flops 104*a* and 104*b*. The first data-type flip-flop 104*a* has its data terminal D coupled to the control switch 100 and its clock terminal CK coupled to a lead 108 connected to a frequency converter 110 which provides a clock pulse *f* as shown in FIGS. 6 and 7. The Q output of the first data-type flip-flop 104*a*is coupled to a clock terminal CK of the second data-type flip-flop 104*b* whose data terminal D is coupled to the Q output of the second data-type flip-flop 104*b*. The second data-type flip-flop 104*b* has its Q output coupled to an input signal inhibiting circuit 112 which will be described in detail hereinafter. The second switching input circuit 106 is comprised of first and second trailing edge triggered data-type flip-flops 106*a* and 106*b*. The first data-type flip-flop 106*a* has its data terminal D coupled to the second control switch 102 and its clock terminal CK coupled to the lead 108 to receive the clock pulse *f* therefrom. The Q output of the first data-type flip-flop 106*a* is coupled to a clock terminal CK of the second data-type flip-flop 106*b*, whose data terminal D is coupled to the Q output of the flip-flop 106*b*. The Q output of the second flip-flop 106*b* is coupled to the input signal inhibiting circuit 112.

The Q outputs of the data-type flip-flops 104*a* and 106*a* are also coupled to inputs of an AND gate 114, whose output is coupled through an inverter 116 to a memory circuit 118 comprised of a trailing edge triggered data-type flip-flops 118*a*. The data-type flip-flop 118*a* has its clock terminal connected CK to the inverter 116, and its data terminal coupled D to Q output of the flip-flop 118*a*. Q output of the flip-flop 118*a* is coupled to a terminal C and the input signal inhibiting circuit 112.

The input signal inhibiting circuit 112 serves to inhibit input signals from being supplied to terminals A and B when both of the control switches 100 and 102 are released at slightly different timings. To this end, the input signal inhibiting circuit 112 comprises inhibiting gate means 120 including a first AND gate 120*a* and a second AND gate 120*b*. The first AND gate 120*a* has one input coupled to the Q output of the data-type flip-flop 104*b* and its other input coupled through an inverter 122 to the Q output of the data-type flip-flop 118. Likewise, the second AND gate 120*b* has its one input coupled to the Q output of the data-type flip-flop 106*b* and its other input coupled through the inverter 122 to the Q output of the data-type flip-flop 118*a*. The input signal inhibiting circuit 112 also comprises an AND gate 124 serving as an inhibition cancelling gate. The inhibition cancelling gate 124 has its inputs connected to the Q outputs of the data-type flip-flops 104*b* and 106*b* and its output coupled through OR gates 126 and 128 to reset terminals R of the flip-flops 104*b* and 106*b*.

As shown, the switch mechanism also comprises first and second switching output circuits 130 and 132 coupled through inverters 134 and 136 to outputs of the AND gates 120*a* and 120*b* of the inhibiting gate means. The first switching output circuit 130 comprises a trailing edge triggered data-type flip-flop 130*a* whose data terminal D is coupled to a positive terminal of a power supply. The flip-flop 130*a* has its clock terminal CK coupled through the inverter 134 to the output of the AND gate 120*a* and its Q output coupled to a terminal A. A reset terminal R of the flip-flop 130*a* is coupled to the lead 108 to which the frequency converter 110 is coupled. The terminal A is coupled to the OR gate 126 whose output is coupled to the reset terminal R of the flip-flop 104*b*. Similarly, the second switching output circuit 132 comprises a trailing edge triggered data-type flip-flop 132*a* having its data terminal D coupled to a positive terminal of the power supply and its clock terminal CK coupled through the inverter 136 to the output of the AND gate 120*b*. Q output of the flip-flop 132*a* is coupled to a terminal B and the OR gate 128. A reset terminal R of the flip-flop 132*a* is coupled to the lead 108.

When, in operation, the first control switch 100 is depressed, an input signal A1 as shown in FIG. 6 is applied to the data terminal D of the data-type flip-flop 104*a* whose clock terminal is applied with clock pulses *f* as shown in FIG. 6. Thus, the data-type flip-flop 104*a* generates an output A2 which builds up at a trailing edge of a clock pulse *f* and builds down at a trailing edge of another clock pulse *f* as shown in FIG. 6. The output A2 is applied to the clock terminal CK of the second data-type flip-flop 104*b*. This flip-flop 104*b* generates an output A3 which builds up at a trailing edge of the pulse A2 as shown in FIG. 6. Since the AND gate 120*a* of the input signal inhibiting circuit 120 is normally opened, the output A3 is gated through the AND gate 120*a* and the inverter 134 to the clock terminal CK of the data-type flip-flop 130*a*, which generates an output A4. The output A4 builds up synchronism with the pulse A3. Since, in this instance, the reset terminal of the data-type flip-flop 130*a* is coupled to the lead 108, it is reset by the clock pulse *f* and, therefore, the output A4 has a width equal to that of the clock pulse *f*. This output A4 is applied through the terminal A to the counter of the electronic timepiece for performing time correction. The output A4 is also applied through the OR gate 126 to the reset terminal of the data-type flip-flop 104*b*, which is consequently reset. It will thus be seen that in this illustrated embodiment an output signal will appear on terminal A after the control switch is released, i.e., during transitions of logic levels of the output A2. The operation of the second control switch 102 is similar to that of the first control switch 100 and, therefore, a detailed description of the same is herein omitted.

When both of the first and second control switches 100 and 102 are depressed, outputs A1 and B1 are generated as shown in FIG. 7. Accordingly, the data-type flip-flops 104*a* and 106*a* produce outputs A2 and B2, respectively. These outputs A2 and B2 are applied to the AND gates 114. Consequently, the AND gate 114 generates an output C1 as shown in FIG. 7 which is applied to the clock terminal CK of the data-type flip-flop 118*a* through the inverter 116. Thus, the data-type flip-flop 118*a* generates an output C2 whish is applied to the inverter 122, thereby inhibiting the AND gates 120*a* and 120*b*. At the same time, the output C2 is applied through the terminal C to the counter of the electronic timepiece for performing a desired function. Since, on the other hand, the outputs A3 and B3 are not generated unless the first and second control switches 100 and 102 are released, the switching output circuits 130 and 132 will not generate outputs A4 and B4 even when a slight time difference exists between the depressions of both of the control switches 100 and 102. When both of the control switches 100 and 102 are released, outputs A3 and B3 are generated by the flip-flops 104*b* and 106*b*, respectively, as previously mentioned. Since, in this instance, the output C2 of the flip-flop 118 is applied to the inverter 122, the AND gates 120*a* and 120*b* are inhibited and, therefore, outputs A4 and B4 will not be produced.

If the outputs A3 and B3 are generated by the flip-flops 104*b* and 106*b* after both of the control switches 100 and 102 have been released, the AND gate 124 generates an output D as shown in FIG. 7 which is applied through the OR gates 126 and 128 to the reset terminals of the flip-flops 104*b* and 106*b* which are consequently reset. At the same time, the output D is also applied to the reset terminal of the flip-flop 118, which is also reset. It will thus be seen that even when both of the first and second control switches 100 and 102 are depressed or released at different timings the outputs A4 and B4 are not generated and only the output C2 is generated as shown in FIG. 7.

If desired, a delay circuit may be provided for applying an output of the AND gate 124 to the reset terminals R of the data-type flip-flops 104*b* and 106*b* prior to the application of the output of the AND gate 124 to the reset terminal R of the data-type flip-flop 118*a*.

It will now be appreciated from the foregoing description that in accordance with the present invention it is possible to provide various switching functions with the use of a minimum number of control switches whereby electronic timepieces of the multi-function type can be manufactured in simple construction. Thus, the switch mechanism of the present invention is specifically suited for use in electronic wristwatches where the number of external switches is limited because of required minimal spacings.

While the present invention has been shown and described with reference to particular embodiments, it should be noted that various other changes or modifications may be made without departing from the scope of the present invention. In addition, although the switch mechanism of the present invention has been shown and described as applied to an electronic timepiece by way of example, it should be understood that the principal concept of the present invention may be utilized in another electronic devices such as calculators or watches equipped with calculators whereby when a switch is singly depressed it serves as a numeral key whereas when selected ones of a plurality of switches are concurrently depressed they serves as a function key while preventing erroneous operation.

What is claimed is:

1. In an electronic timepiece having a plurality of control switches, the improvement comprising:

first means coupled to a first of said control switches for generating an output corresponding to a first switching function when said first of said control switches is actuated;

second means coupled to a second one of said control switches for generating an output corresponding to a second switching function when said second of said control switches is actuated;

third means coupled to first and second control switches for generating an output corresponding to a third switching function when said first and second control switches are concurrently actuated; and said first and second means coupled to said third means whereby said first and second switching functions are inhibited when said third means generates the output corresponding to said third switching means.

2. The improvement according to claim 1, in which said first and second means comprise first and second timers, respectively, which are arranged to generate said outputs when a predetermined time interval has passed after the actuations of said control switches.

3. The improvement according to claim 2, in which said third means comprises a third timer arranged to generate the output corresponding to said third switching function.

4. The improvement according to claim 3, in which each of said timers comprises a plurality of flip-flops coupled in series.

5. The improvement according to claim 4, in which said third means also comprises gate means having its inputs coupled to said plurality of control switches and its output coupled to said third timer.

6. The improvement according to claim 1, in which said each of said first, second and third means comprises gate means.

7. The improvement according to claim 6, in which said third means further comprises a wave shaping circuit coupled to an output of said gate means.

8. The improvement according to claim 6, in which said gate means of said third means has its output coupled to inputs of said gate means of said first and second means through an inverter.

9. The improvement according to claim 6, further comprising fourth means coupled to said plurality of control switches and enabling said gate means of said first and second means when a predetermined time interval has passed after the actuations of said plurality of control switches.

10. The improvement according to claim 9, in which said fourth means comprises an OR gate having its inputs coupled to said plurality of control switches, a counter having its reset terminal coupled to an output of said OR gate, and a wave shaping circuit coupled between said OR gate and said counter.

11. The improvement according to claim 9, in which said fourth means comprises an OR gate having its inputs coupled to said plurality of control switches, a timer coupled to an output of said OR gate, an AND gate having its one input coupled to said timer and its output coupled to inputs of said gate means of said first and second means, and a counter coupled to another input of said AND gate.

12. The improvement according to claim 1, in which said first and second means includes switching means for generating said outputs when said control switches are released from their depressed conditions.

13. The improvement according to claim 12, in which said switching means comprises a plurality of trailing edge triggered data-type flip-flops.

14. The improvement according to claim 12, in which said third means comprises a memory circuit, and an AND gate having its inputs coupled to said plurality of control switches and an output coupled to said memory circuit.

15. The improvement according to claim 14, in which said memory circuit comprises a trailing edge triggered data-type flip-flop.

16. The improvement according to claim 14, further comprising inhibiting means coupled to outputs of said switching means and responsive to an output of said memory circuit for inhibiting the outputs of said switching means.

17. The improvement according to claim 15, further comprising means for resetting said data-type flip-flops when said control switches are released at different times.

* * * * *